US006364508B1

(12) United States Patent
Moreland

(10) Patent No.: US 6,364,508 B1
(45) Date of Patent: Apr. 2, 2002

(54) CHANNEL SYSTEM FOR LIGHT STRINGS

(76) Inventor: Karren Moreland, 1102 E. Country Gables, Phoenix, AZ (US) 85022

( * ) Notice: Subject to any disclaimer, the term of this patent is extended or adjusted under 35 U.S.C. 154(b) by 0 days.

(21) Appl. No.: 09/571,249

(22) Filed: May 16, 2000

(51) Int. Cl.[7] ..... F21V 21/00

(52) U.S. Cl. ..... 362/249; 362/219; 362/250; 362/391; 362/396; 362/806

(58) Field of Search ..... 362/239, 249, 362/250, 391, 396, 806, 219, 387

(56) References Cited

U.S. PATENT DOCUMENTS

| | | | | |
|---|---|---|---|---|
| 2,692,375 A | | 10/1954 | Carson | 339/99 |
| 3,569,691 A | | 3/1971 | Tracy | 240/10 |
| 3,692,993 A | | 9/1972 | Robinson | 240/10 |
| 3,836,936 A | | 9/1974 | Clement | 339/21 R |
| 4,128,863 A | | 12/1978 | Premetz | 362/249 |
| 4,482,944 A | | 11/1984 | Roossine et al. | 362/418 |
| 4,573,108 A | | 2/1986 | Castiglia et al. | 362/123 |
| 5,067,061 A | | 11/1991 | Prickett | 362/145 |
| 5,154,509 A | | 10/1992 | Wulfman et al. | 362/226 |
| 5,469,344 A | | 11/1995 | Kotsakis | 362/145 |
| 5,513,081 A | | 4/1996 | Byers | 362/145 |
| 5,544,028 A | | 8/1996 | Carlin | 362/249 |
| 6,050,703 A | * | 4/2000 | Herbert | 362/145 |
| 6,135,615 A | * | 10/2000 | Lee | 362/250 |

* cited by examiner

*Primary Examiner*—Stephen Husar
*Assistant Examiner*—Guiyoung Lee
(74) *Attorney, Agent, or Firm*—The Halvorson Law Firm

(57) ABSTRACT

The present invention is a kit or a channel system useful for the removable mounting (installation and removal) of ornamental light strings onto buildings such as houses, offices, stores, and the like. The system according to the present invention has at least one, preferably a series of, display channel pieces, or tracks, that are attached to a surface of a building, such as a house, store, office, or the like. The channel pieces are coupled together with coupling tabs. In one embodiment there are at least two corner pieces (first and second corner pieces) are provided to allow for three dimension of mounting of the ornamental light strings. Slide mounts moveably fit within, and work with, channels within the channel pieces and are used to moveably secure ornamental light strings to the system when in use. A slide mount guide is used to urge the mounted light string from a storage channel piece to the display channel pieces.

12 Claims, 6 Drawing Sheets

CHANNEL SYSTEM FOR LIGHT STRINGS

FIELD OF THE INVENTION

The present invention relates to the field of ornamental light string mounting devices. More specifically, the present invention relates to a channel track system for the moveable and removable mounting of ornamental light strings to the exterior of buildings and the like.

BACKGROUND

It has become common practice to decorate homes or other buildings during holiday seasons, such as Christmas, Halloween, Easter, and the like, by attaching strings of lights to achieve a decorative effect. The strings of lights are typically secured beneath overhanging eaves and around gables, and are also positioned to outline architectural features of the homes, such as windows and the like.

The strings of lights are usually secured in place by simple connectors such as staples. This method however, due to repetitive installation and removal of the staples, results in considerable marring of the wooden mounting surfaces. Longs strings of lights, as are typically used, are difficult to install and consequently a householder is often inclined to leave the lights in place once they are secured. Although this avoids yearly installation and removal, the strings of lights are exposed to weather for the full year resulting in their early deterioration and, furthermore, they add nothing to, and in fact detract from, the appearance of a house between holiday seasons. Further, the permanently attached light strings may conveniently express only a single holiday.

Light holders have heretofore been devised for attachment to buildings for attaching strings of lights in a regular manner and which afford the light strings some protection from the weather. These light holders required periodic use of a ladder while installing and removing the holiday light strings. Alternately, if the lights are left in place, they are continuously exposed to view. Consequently, unless the homeowner is content to accept the detraction from the aesthetic qualities of this home, the holders must be installed and removed each Christmas season.

SUMMARY OF THE INVENTION

It is an object of the present invention to provide a channel system for the mounting of ornamental light strings.

It is another object of the present invention to provide a channel system for ornamental light strings that is inconspicuously mountable onto the exterior/interior of a building and that allows for adjustable placement and removal of the ornamental light strings.

It is a further object of the present invention to provide a storage system for ornamental light strings that functions in combination with a building mountable light string channel system.

It is yet another object of the present invention to provide a channel system that uses specifically designed slide mounts for mounting light strings, said slide mounts designed to travel along a slide mount channel formed in the channel pieces of a mountable channel system, there further being provided a slide mount slide handle useful for moving and placing the slide mounts of the present invention.

It is yet a further object of the present invention to provide a channel system that includes at least one type of corner piece that allows for angular tracking of the light string.

It is still yet another object of the present invention to provide a channel system that is coupled together by a removable coupling insert, thereby provide for contiguous and continuous movement and placement of the ornamental light string.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DESCRIPTION OF PREFERRED EMBODIMENTS

Figure 1:
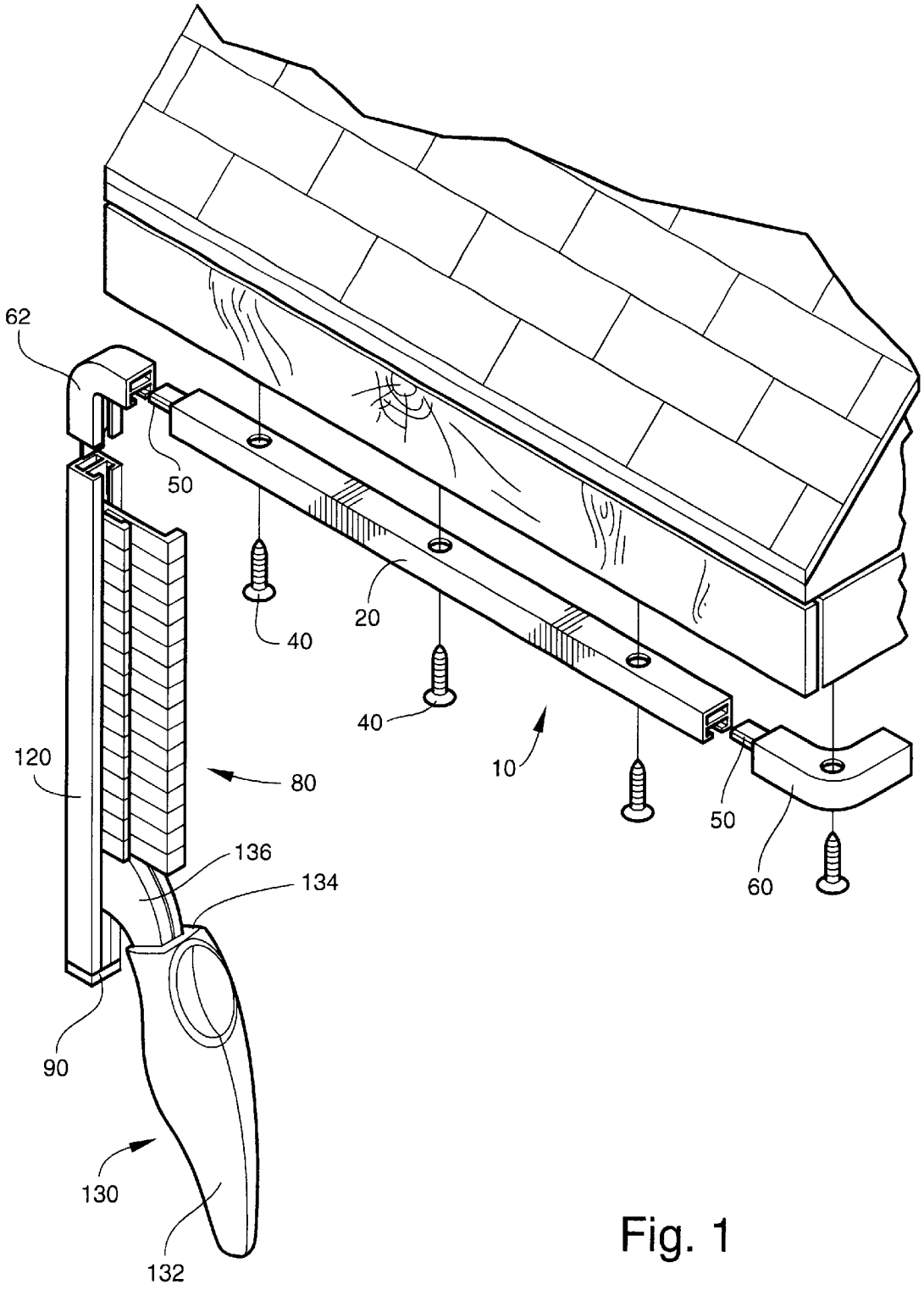
FIG. 1 is an exploded view of the system according to the present invention.
Figure 2:
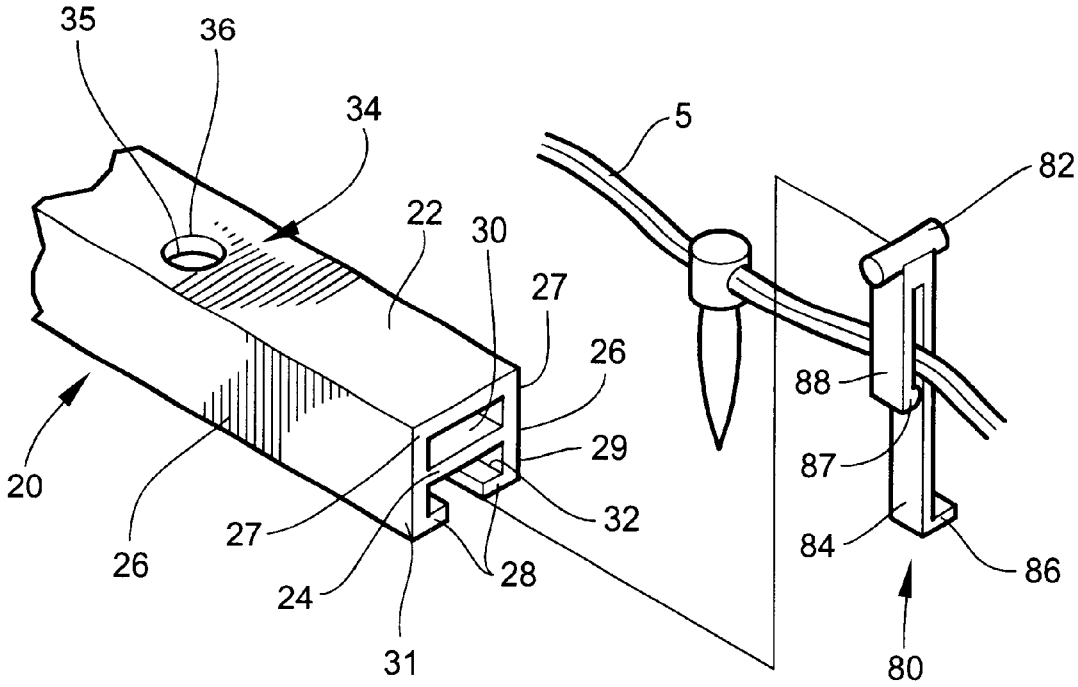
FIG. 2 is an exploded close-up of a channel illustrating how the slide mount of the present invention slideably mounts into the channel according to the present invention.
Figure 3:
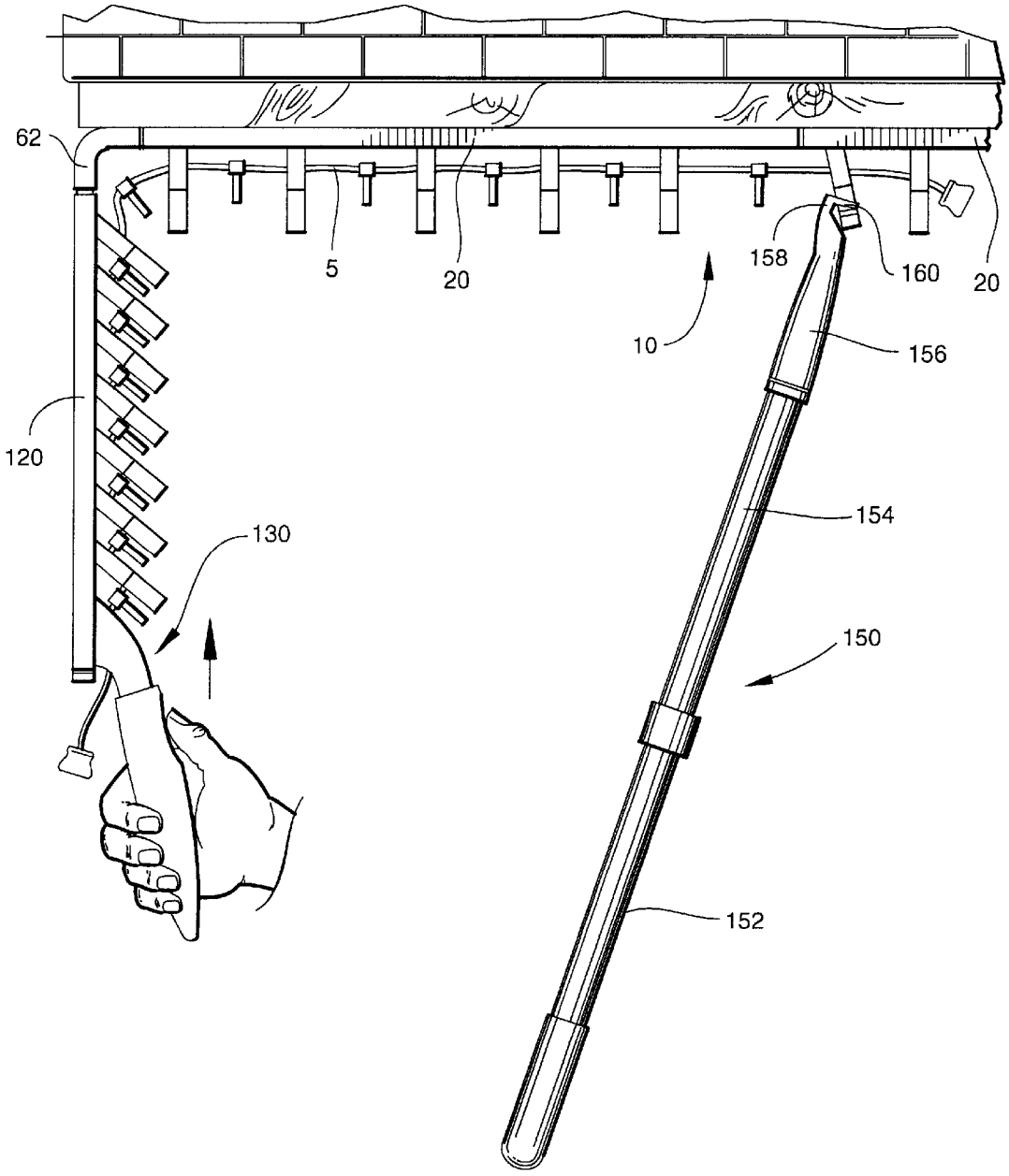
FIG. 3 is a side view illustrating how the system according to the present invention functions.
Figure 4:
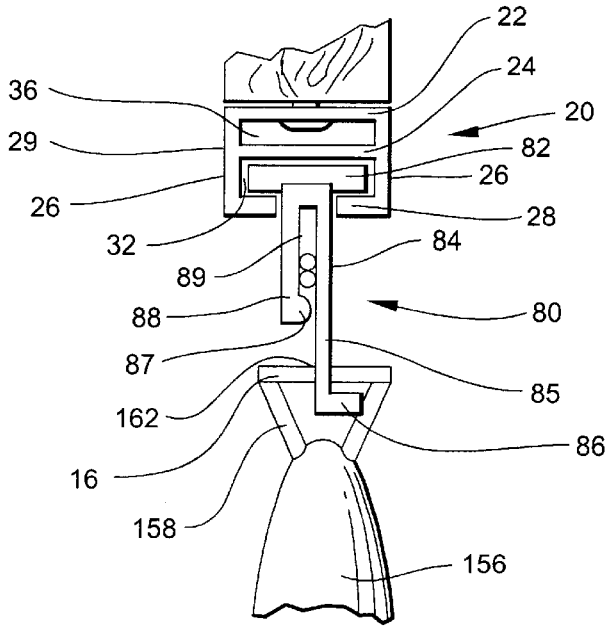
FIG. 4 is a view along the direction of the channel illustrating how the slide mount of the present invention fits into the channel according to the present invention.
Figure 5:
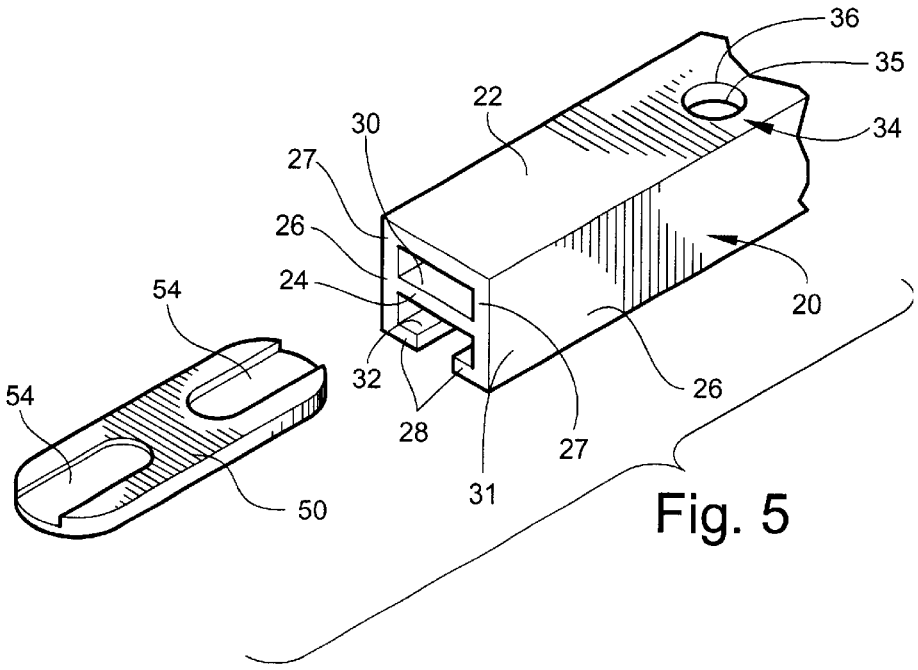
FIG. 5 is shows a coupling tab and how it fits into the channel according to the present invention.
Figure 6:
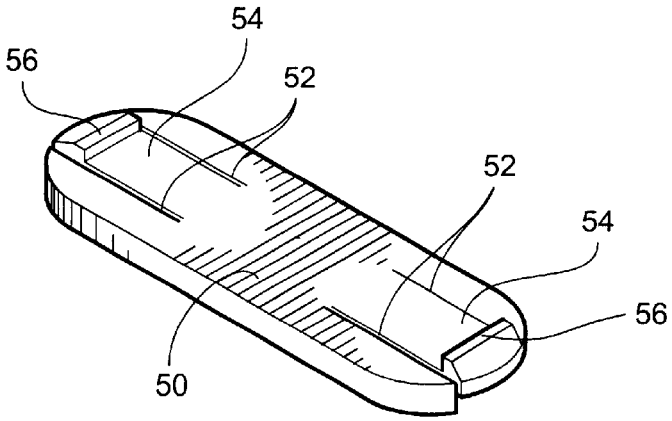
FIG. 6 is a bottom view of the coupling tab.
Figure 7:
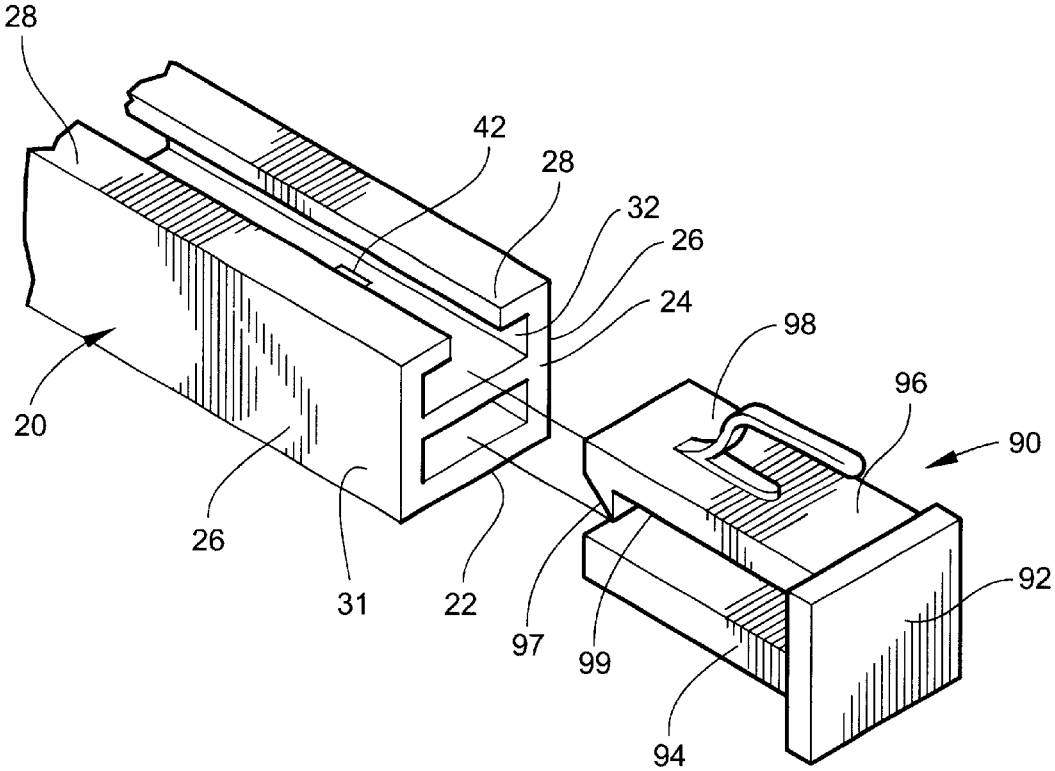
FIG. 7 shows an end cap according to the present invention.
Figure 8:
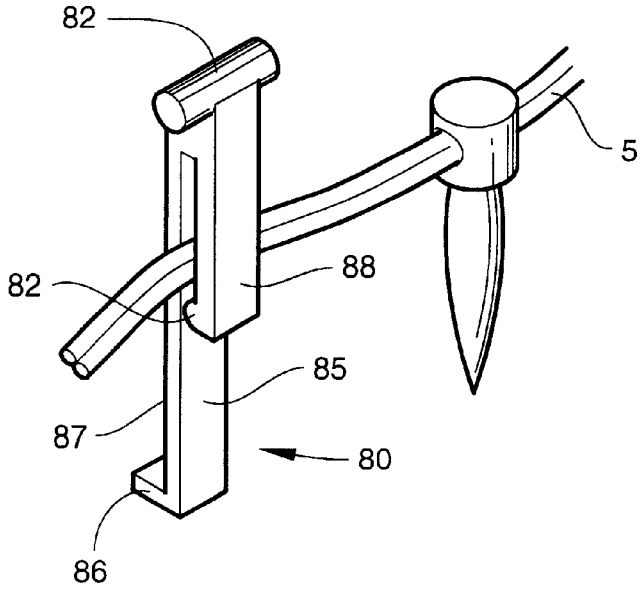
FIG. 8 is a perspective view of the slide mount according to the present invention.
Figure 9:
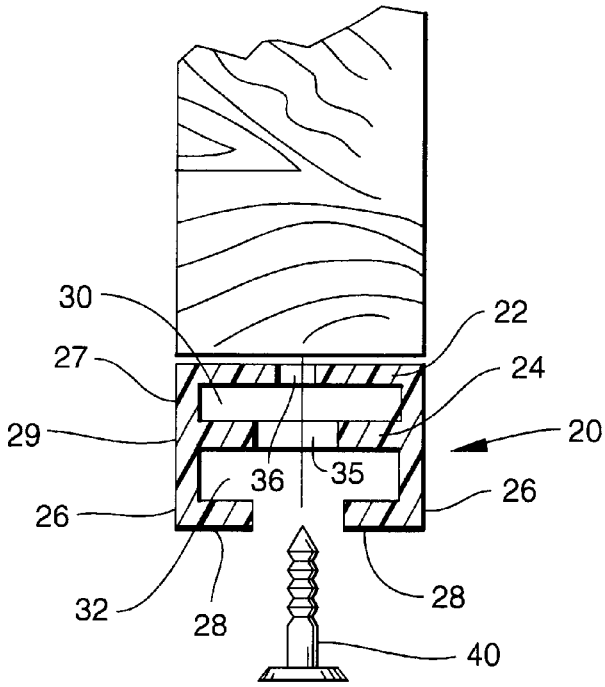
FIG. 9 is a is a view along the longitudinal direction of the channel according to the present invention illustrating how the channel is mounted onto a surface of a building.

The present invention is a kit or a channel system 10 useful for the removable mounting (installation and removal) of ornamental light strings 5 onto buildings such as houses, offices, stores, and the like.

The system 10 according to the present invention has at least one, preferably a series of display channel pieces 20, or tracks, that are quasi-permanently attached to a surface of a building, such as a house, store, office, or the like. The channel pieces 20 are coupled together with coupling tabs 80. In one embodiment, at least two corner pieces (first and second corner pieces 60 and 62) are provided to allow for three dimension of mounting of the ornamental light strings 5. In an alternate embodiment, the channel piece are mitered at individual ends to closely fit the outline of the building while still allowing moveable mounting of the light string.

The channel pieces 20 according to the present invention are long pieces, preferably made from plastic, that include a back wall 22, an intermediate wall 24, two side walls 26, and two inwardly disposed ledges 28. The back wall 22 extends between back ends 27 of the side walls 26, respectively. The intermediate wall 24 extends between middle locations 29 of the side walls 26, respectively. The space defined by these four walls is a coupling channel 30 that extends the entire length of the channel piece 20. It is useful to note that the coupling channel 30 need only extend along a small portion of the channel piece 20, at both ends respectively. It is preferred, for economic and manufacturing reasons, that the coupling channel 30 extends the entire length of the channel piece 20. Furthermore, this allows the channel pieces 20 to be cut to any desired length when mounted onto the building.

The two inwardly disposed ledges 28 extend inwardly from front ends 31 of the side walls 26, one on each side wall, respectively. While the two ledges 28 are directed toward each other, they do not meet, thereby creating a slide mount channel 32 that extends the length of the channel piece 20. It is critical to the present invention that the slide mount channel 32 extends the entire length of the channel piece 20.

Located periodically along the length of the channel piece 20 is at least one mounting aperture 34 that extend through the intermediate and back walls, 24 and 22, respectively. Preferably, each aperture 35 that extends through the intermediate wall 24 is larger than the aperture 36 that extends through the back wall 22. This allows the head of mounting hardware 40, such as a screw, bolt, nail, or the like, to pass through the intermediate wall 24 and press against the back wall 22 thereby snuggly securing the entire channel piece 20 to the surface of the building. Alternately, the channel piece 20 may be made from a material that is pierceable by the mounting hardware 40 thereby eliminating the need for the aperture 36 that extends through the back wall 22. Thus, the mounting hardware 36 is placed in the aperture 35 that extends through the intermediate wall 24 and is forced through the back wall 22, thereby piercing the back wall 2, and into the mounting surface of the building. Finally, the channel system may be adhesively attached to the building by strong adhesives or the like.

Located near the opposite ends of the channel pieces 20, in the intermediate wall 24, are two tooth receiving cut-outs 42, one at each end. The use of these cut-outs 42 will be discussed below.

The channel pieces 20 are coupled together by coupling tabs 50. The coupling tabs 50 are preferably thin or flat longitudinal tabs. The coupling tabs 50 are sized to snuggly fit within the coupling channel 30. Located at each end of each tab 50 are a pair of slits 52 that extends from the end inwardly a portion of the length of the tab 50. Each pair of slits 52 defines a flexible tang 54. Each flexible tang 54 has a tooth 56 located on one surface. The tang 54 should be thinner than the tab 50 by the thickness of the mounted tooth 56. Preferably, each corner of the tab 50 is rounded.

In use, the one end of a tab 50 is inserted into an access opening to the coupling channel 30 located at each end of the channel piece 20. The tab 50 is forced into the coupling channel 30 until the tooth 56 located on the flexible tang 54 engages the tooth receiving cut-out 42. This, then, locks the tab 50 into place. This process is repeated with another channel piece 50 for the remaining end of the tab 50, thereby coupling two channel pieces 50 together.

However, since the tang 54 upon which the tooth 56 is mounted is flexible, it is obvious that the tab 50 may be removed by pulling the tang 54 away from the intermediate wall 24, thereby disengaging the tooth 56 from the tooth receiving cut-out 42, and forcing the tab 50 out the of coupling channel 30. Thus, it can be seen that it is preferred that the tab 30 have a width approximately that of the distance that separates the two ledges 28, such that the tang 54, when pulled away from the intermediate wall 24, may fit between the two ledges 28 for disengagement.

When a corner is encountered on the building being decorated, the substantially straight channel pieces 20 may mitered to the appropriate angles or they may be coupled together with one of at least two corner pieces that would be provided with the system. A first corner piece 60 is used for coupling two channel pieces 20 within the same horizontal plane. This situation occurs when a corner of the building or eave is encountered. This corner piece 60 has the same basic structure as the substantially straight channel piece 20, but with an angled bend, preferably substantially ninety-degrees, directed toward one of the sides. Preferably, this corner piece 60 is a short piece having a single mounting aperture34 located in the bend of the corner piece 60.

A second corner piece 62 is used for coupling two channel pieces 20 within the same vertical plane. This situation occurs when the light string travels up a wall of the building or surface and then immediately along the roofline, or other horizontal direction. This situation also occurs when mounted light strings 5 are transferred from a storage piece to the mounted system 10. This second corner piece 62 has the same basic structure as the substantially straight channel piece 20, but with an angular bend, preferably substantially ninety degrees, directed away from the back wall 22 of the corner piece 62. Preferably this corner piece 62 is a short piece having a single mounting aperture 34 located in a straight section of the corner piece 62, immediately adjacent the bend.

Alternatively, the corner piece 60 may be made from a flexible material that allow bending of the corner piece 60 thereby enabling odd angles and/or out of plane coupling.

A plurality of slideable slide mounts 80 are included to moveably couple light strings 5 to the channel system 10. Each insert 80 has a slideable crossbar 82 with an attached light string securing portion 81. Preferably, the slideable crossbar 82 is generally cylindrically shaped. In one embodiment the string securing portion 81 is two depending legs: a long leg 84 and a short leg 88. The long leg 84 is generally L-shaped with a long portion 85 and a short portion 86. The long portion 85 of the L-shape is attached to the slideable crossbar 82. The short portion 86 of the L-shape is used as a catch for an insert sliding handle 150, as will be discussed below. The short leg 88 has a tooth portion 87 on an inside face 89. There is a space between the short and long legs, 88 and 84 respectively, that receives electrical wire portions of the light strings 5. The tooth portion 87 on the short leg 88 acts to removably retain the wire portion of the light strings 5. Two ends of the slideable crossbar 82 extend beyond the width of the short and long legs, 88 and 84. The extension allows the slideable crossbar 82 to slideably interact with the two ledges 28 of the channel pieces 20 and corner pieces 60 and 62. Preferably the thickness of the short and long legs 88 and 84 is approximately the same as the space between the two ledges 28.

In another, more preferred embodiment, the string securing portion 81 includes two string securing arms 182 having an inwardly directed piece 184, such as a tooth. This piece 184 is used to prevent the light string, once mounted, from casually disengaging from the slide mount 80. Additionally, there is a light clasp 186 that is substantially circular in shape. The clasp 186 has a ingress slit 188 that is used to allow entrance of a mounted light, or a portion of the mounted light, on a light string. This, then, allows the light to be secured close to the channel pieces 20 and allows for easier positioning.

Additionally, an end cap 90 is provided for sealing uncoupled ends of each channel piece 20. The end cap 90 has an end piece 92 with two legs, 94 and 96. A first leg 94 that is sized to fit within the coupling channel 30 and a second leg 96 that is sized to substantially fit within the slide mount channel 32. The second leg 96 of the end cap 90 further has a tooth 97 located at a distal end 98 of the second leg 96, on an inside side 99 of the leg, for engaging the cut-out 42 located at the end of the channel piece 20. Thus, when in place the end piece 90 provides a finished look to the channel system 10 and prevents the ornamental light strings 5 from accidentally being moved past an unused end of the channel piece 20 and falling out of the system 10. In a preferred embodiment the end piece 90 includes a slide mount finger 93. The slide mount finger 93 is used to securely position a terminal slide mount 80 such that once in place, the slide mount 80 does not easily move position by such forces as wind and the like. It is preferred that an elastic band, or other like structure, couple between the terminal slide mount 80 and the slide mount finger 93. Thus, by removing the elastic band, the terminal slide mount 80 may be removed with the other slide mounts 80.

When in use, the plurality of channel pieces 20 and corner pieces 60 and 62 are mounted to an exterior (or interior) surface of a building to form a contiguous channel system 10. More than one separate channel system 10 may be mounted on any single building. Each contiguous channel system 10 has two uncoupled ends. One end may have a second corner piece 62 attached thereto, while the remaining uncoupled end should have an end cap 90 mounted therein. Alternately, for ease of application, another second corner piece 62 may be mounted to the remaining uncoupled end. Once the contiguous channel system 10 is mounted to the building it is ready for light strings 5 to be mounted therein.

In the preferred embodiment, a separate storage channel piece 120, with an end cap 90 mounted at one end, contains and stores light strings 5 to be mounted on the channel system 10. The separate storage channel piece 120 serves as a loader for moving the ornamental light strings onto the channel system. A plurality of slide mounts 80 are fitted within the slide mount channel 32 and the light strings 5 are attached to the slide mounts 80. The storage channel 120 is then coupled to the mounted channel system 10, preferably using one of the second corner pieces 62. The light string 5, mounted on the plurality of slide mounts 80, may then be moved from the storage channel piece 120 to the mounted channel systems 10 and arranged for decoration.

It is preferred that the light string 5 mounted on the plurality of slide mounts 80 be moved from the storage channel 120 to the mounted channel system 10 using a hand-held slide mount guide 130. The guide 130 has a handle 132 that is preferably conformed to a human grip. Located at a distal end 134 of the handle 132 of the guide 130 is a guide piece 136. The guide piece 136 is placed underneath (or adjacent to) the light string 5 mounted on the plurality of slide mounts 80 and used to urge or force the mounted light string 5 from the storage channel piece 120 to the mounted channel system 10. In its most preferred form, the guide piece 136 has a width that fits within the space between the two ledges 28 of the channel piece 20. Thus, the pressure exerted by the guide piece 136 may be applied directly to the crossbar 82 of the plurality of slide mounts 80.

Once the mounted light string 5 has been transferred from the storage channel 120 to the mounted channel system 10, the storage channel piece 120 may be removed and the individual lights of the light string 5 may be spaced apart according to the wishes of the user by strategic placement of the mounting slide mounts 80. These are conveniently placed using the longer insert slide handle 150.

The slide handle 150 is preferably extendable, with a telescoping handle portion 152 that is commonly found in the arts of telescoping handles. Attached at a distal end 154 of the telescoping handle portion is a slide guide 156. The slide guide 156 has a substantially L-shaped tip 158, with a long leg 159 and a short leg 160. The long leg 159 of the L-shaped tip 158 is attached to the distal end 154 of the handle portion 152. The short leg 160 of the L-shaped tip 158 has a slot 162 that removably receives the long leg 84 of the slideable insert 80. The short portion 86 of the long leg 84 catches an underside of the tip 158 to allow the slide handle 150 to "drag" or "pull" the insert 80 into the desired position.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A kit for mounting ornamental light strings comprising a. at least one display channel piece having a back wall extending between two side walls and an intermediate structure that extends from the two side walls thereby creating a coupling channel therebetween, the channel piece further having two inwardly disposed ledges that extend inwardly from front ends of the side walls, respectively, thereby creating a slide mount channel that extends the length of the channel piece;

b. at least one coupling tab that is sized to fit within the coupling channel and thereby couple two channel pieces together;

c. a storage channel having a back wall extending between two side walls and an intermediate structure that extends from the two side walls thereby creating a coupling channel therebetween, the channel piece further having two inwardly disposed ledges that extend inwardly from front ends of the side walls, respectively, thereby creating a slide mount channel that extends the length of the channel piece;

d. at least one slide mount having a first end that is adapted to work with the slide mount channels in the channel pieces for movably transferring a light string between channel pieces and mounting the light string to the channel pieces; and e. a slide mount guide for moving slide mounts from the storage channel piece to the at least one display channel piece.

2. The kit as in claim 1 further including at least one end cap having an end piece with two legs, a first leg and a second leg, said first leg sized to fit within the coupling channel and said second leg sized to substantially fit within the slide mount channel.

3. The kit as in claim 1 wherein the first end of the slide mount further includes a slideable crossbar with an attached light string securing portion, said slideable crossbar sized to movably fit within the slide mount channel of the channel pieces.

4. The kit as in claim 2 wherein the first end of the slide mount further includes a slideable crossbar with an attached light string securing portion, said slideable crossbar sized to movably fit within the slide mount channel of the channel pieces.

5. The kit as in claim 1 wherein the slide mount guide further has located at a distal end of a handle portion a guide piece, said guide piece having a width that fits with the space between the two ledges of the channel piece.

6. The kit as in claim 2 wherein the slide mount guide further has located at a distal end of a handle portion a guide piece, said guide piece having a width that fits within and extends between the space between the two ledges of the channel piece.

7. The kit as in claim 3 wherein the slide mount guide further has located at a distal end of a handle portion a guide piece, said guide piece having a width that fits within and extends between the space between the two ledges of the channel piece.

8. The kit as in claim 4 wherein the slide mount guide further has located at a distal end of a handle portion a guide piece, said guide piece having a width that fits within and extends between the space between the two ledges of the channel piece.

9. A kit for mounting ornamental light strings comprising a. at least one display channel piece having a back wall extending between two side walls and an intermediate structure that extends from the two side walls thereby creating a coupling channel therebetween, the channel piece further having two inwardly disposed ledges that extend inwardly from front ends of the side walls, respectively, thereby creating a slide mount channel that extends the length of the channel piece;

b. at least one coupling tab that is sized to fit within the coupling channel and thereby couple two channel pieces together;

c. a storage channel having a back wall extending between two side walls and an intermediate structure that extends from the two side walls thereby creating a coupling channel therebetween, the channel piece further having two inwardly disposed ledges that extend inwardly from front ends of the side walls, respectively, thereby creating a slide mount channel that extends the length of the channel piece;

d. at least one end cap having an end piece with two legs, a first leg and a second leg, said first leg sized to fit within the coupling channel and said second leg sized to substantially fit within the slide mount channel;

e. at least one slide mount having a first end that is adapted to work with the slide mount channels in the channel pieces for movably transferring a light string between channel pieces and mounting the light string to the channel pieces, the first end of the slide mount further includes a slideable crossbar with an attached light string securing portion, said slideable crossbar sized to movably fit within the slide mount channel of the channel pieces; and f. a slide mount guide for moving slide mounts from the storage channel piece to the at least one display channel piece, the slide mount guide further has located at a distal end of a handle portion a guide piece, said guide piece having a width that fits with the space between the two ledges of the channel piece.

10. The kit as in claim 9 wherein the channel pieces further include at least one aperture for mounting the channel piece to a surface of a building.

11. The kit as in claim 9 further including a slide handle that has a handle portion and a slide guide, said slide guide used to position the slide mounts when the kit is in use.

12. The kit as in claim 10 further including a slide handle that has a handle portion and a slide guide, said slide guide used to position the slide mounts when the kit is in use.

* * * * *